US005116588A

United States Patent [19]

Sulzbacher et al.

[11] Patent Number: 5,116,588

[45] Date of Patent: May 26, 1992

[54] PROCESS FOR REDUCTION OF SULFUR EMISSION DURING SINTERING PROCESSES

[75] Inventors: Horst Sulzbacher; Harald Derler; Heinz Schöllnhammer, all of Leoben, Austria

[73] Assignees: Voest-Alpine Stahl Donawitz Gesellschaft m.b.H., Leoben; Voest-Alpine Stahl Linz Gesellschaft m.b.H., Linz, both of Austria

[21] Appl. No.: 591,096

[22] Filed: Oct. 1, 1990

[30] Foreign Application Priority Data

Oct. 6, 1989 [AT] Austria ..... A2315/89

[51] Int. Cl.[5] ..... B01J 8/00; C01B 17/00

[52] U.S. Cl. ..... 423/244

[58] Field of Search ..... 423/244 A, 243, 244 R, 423/242 R

[56] References Cited

U.S. PATENT DOCUMENTS 4,093,451 6/1978 Cass et al. ..... 75/43

FOREIGN PATENT DOCUMENTS 0287815 10/1988 European Pat. Off. .
19591 2/1882 Fed. Rep. of Germany ..... 423/244
131959 2/1983 Fed. Rep. of Germany .
234059 3/1986 Fed. Rep. of Germany .
58-76728 5/1983 Japan .

*Primary Examiner*—Gregory A. Heller
*Attorney, Agent, or Firm*—Cushman, Darby & Cushman

[57] ABSTRACT

In a process for reduction of pollutant emissions during thermal processes, particularly sintering processes, in which a combustible mixture, particularly a coke bed, is ignited, the fuel-containing mixture, particularly the coke is rolled with $Ca(oH)_2$ or impregnated with a lime hydrate sludge before feeding the fuel-containing mixture.

8 Claims, 1 Drawing Sheet

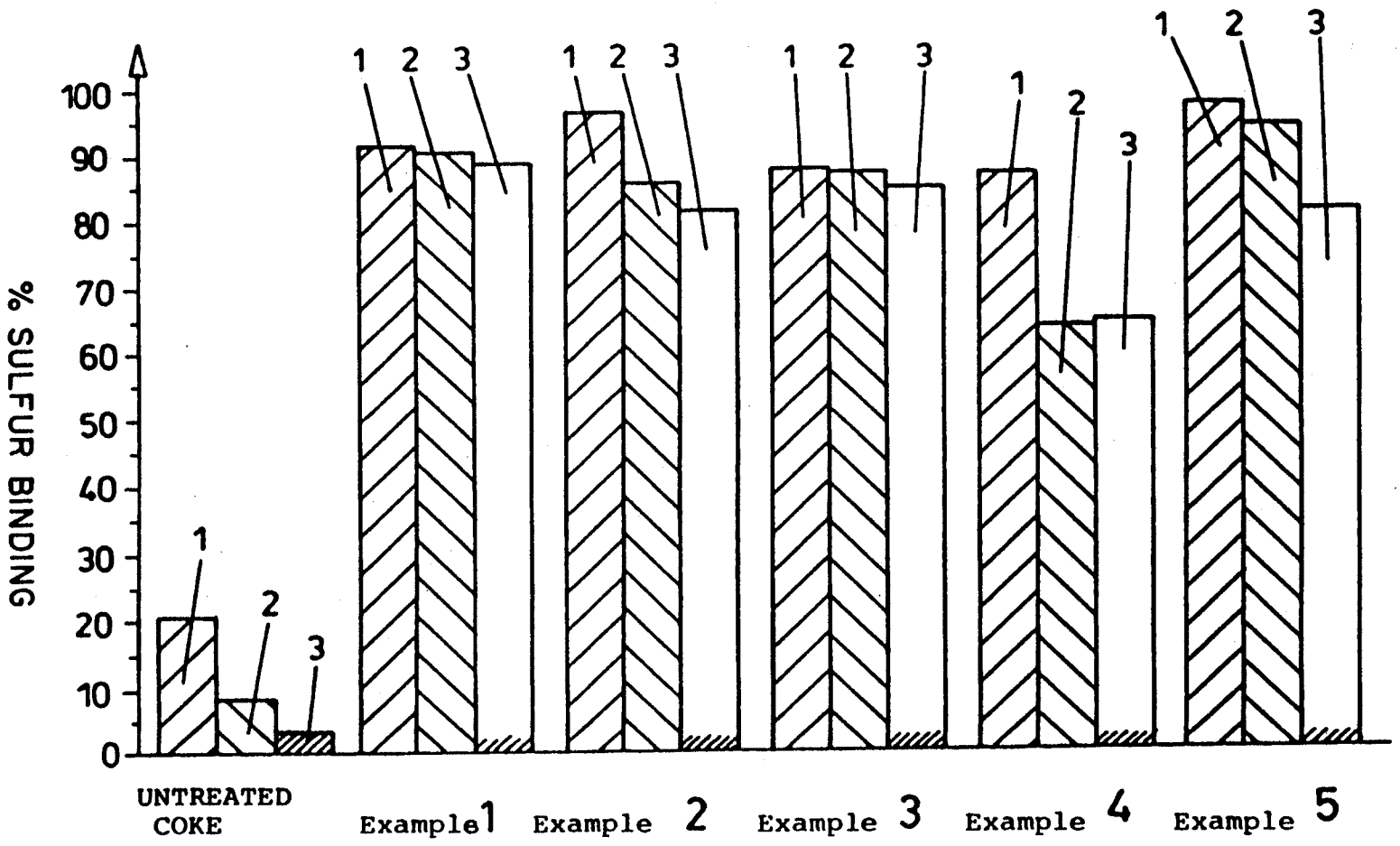
% SULFUR BINDING
100
90
80
70
60
50
40
30
20
10
0
UNTREATED COKE
Example 1
Example 2
Example 3
Example 4
Example 5
1
2
3

PROCESS FOR REDUCTION OF SULFUR EMISSION DURING SINTERING PROCESSES

The invention relates to a process for reduction of pollutant emissions during thermal processes, like particularly sintering processes, in which a mixture containing a fuel, particularly a coke bed, is ignited.

A process is already known from EP-Al 39 305 for reduction of pollutant emissions during sintering, in which an extra grate layer is used as an intermediate layer between the raw sinter layer and the sintering grate. The suggested intermediate layer hereby consists of granular material which is supposed to be capable of removing pollutants. This granular absorption material is dampened for significant pollutant emission, whereby particularly good results are achieved with basic sludge and/or fluids. Lime solution is specified as the preferable basic sludge, whereby in addition to the coke ash a correspondingly large volume of sulfur-containing waste products is formed. In this type of sintering systems, for example, preliminary products for metal winning are produced from ore, whereby ore mixtures, concentrates, smelting circulation materials are supplied to the sintering system together with coke fines. For a layer thickness of about 40 cm of the sinter mixture, layer thicknesses of between 2.5 and 15 cm are suggested for the additional grate layer in order to achieve an effective sulfur removal.

SUMMARY OF THE INVENTION

The goal of the invention is to achieve a process of the type mentioned at the beginning in which a reduction of pollutant emissions, particularly an almost complete removal of sulfur from the waste gases, can be achieved without expensive flue gas sulfur removal, without increase in the quantity of material with increased pollutants to be treated. To solve this task, the invention basically consists of the fact that the porous fuel portion, particularly the coke, of the mixture before feeding the fuel-containing mixture is rolled with $Ca(OH)_2$ or impregnated with a lime hydrate sludge. The process of rolling the porous fuel portion with $Ca(OH)_2$, particularly the coke, of the mixture before feeding the fuel-containing mixture or of impregnating it with a lime hydrate sludge did not suggest itself at all since the prejudgment of the technical world was that this type of addition to porous fuel portions, particularly coke, has a sensitive influence on the ignition temperature and particularly results in an increase in the ignition temperature. Surprisingly, it has been shown that with the use of dry lime hydrate the ignition temperature of the coke remains almost unchanged while with the use of lime hydrate sludges the ignition temperature of the coke pretreated in this way could even be lowered. With the lowering of the reaction temperatures, the requirements for an effective sulfur removal were significantly improved at the same time and far more than 90% of the sulfur binding could be achieved effortlessly.

BRIEF DESCRIPTION OF THE FIGURE

FIG. 1 represents a block diagram of the sulfur binding in the ashes. Specifically, the percent of sulfur binding is represented on the ordinate axis. The results of the three incineration tests executed with untreated coke and with the sinter coke fine treated with lime hydrate are represented on the abscissa axis.

DETAILED DESCRIPTION OF THE INVENTION

The process according to the invention is hereby preferably executed in such a way that, related to the coke quantity, 5–30 weight % $Ca(OH)_2$, preferably 10–25 weight %, is added in dry form and the coke is rolled together with the lime hydrate. While maintaining the named limit values for the lime hydrate addition, an almost unchanged coke ignition temperature could be maintained in the case of rolling coke with dry lime hydrate, whereby with a treatment of the dried coke with lime hydrate sludge in the named weight percents, a decrease in the ignition temperature by 40°–45° C. was observed. A low ignition temperature of this sort had a higher reactivity as a consequence and led to particularly good sulfur binding in the ashes.

In the case of impregnating the fuel with lime hydrate, preferably a sludge of $Ca(OH)_2$ in 1 to 3 weight parts water per weight part $Ca(OH)_2$ was used. Surprisingly, sludges with one weight part $Ca(OH)_2$ and one weight part $H_2O$ and sludges with one weight part $Ca(OH)_2$ and three weight parts $H_2O$ resulted in a particularly great decrease in ignition temperature, in contrast to which a treatment of coke with a sludge of one weight part $Ca(OH)_2$ to two weight parts $H_2O$ still resulted in a reduction of ignition temperature of about 35° C. In spite of this decreased reduction of ignition temperature while maintaining a weight ratio of 1:2, a coke fine treated with a lime hydrate sludge in weight ratio 1:2 exhibited especially high sulfur binding values in the ashes, if simultaneously the incineration temperature was kept lower.

For this type of sintering purposes, as mentioned above, primarily coke fine is used as sintering coke and in the scope of the process according to the invention, preferably sintering coke in a granule range of 0.5–5 mm, preferably 1 to 3 mm, is used.

It has proven to be particularly advantageous if before rolling and/or before treatment with the lime hydrate sludge, the sinter coke to be used is dried, whereby temperatures around 100° C. appear particularly suitable as drying temperatures.

During usage of a lime hydrate sludge, high sulfur binding can be achieved with simultaneous low use of foreign material by the fact that the lime hydrate sludge is used in a quantity of 20–50, preferably 25 to 50 weight %, related to coke. As mentioned already above, the sulfur binding can be further optimized by control of the process temperatures and according to a preferred method of operation the procedure can be such that the sinter temperatures are kept low.

The invention will be explained in more detail using examples.

EXAMPLE 1

1000 g sinter coke with a particle size of 1 to 3 mm were dried at 105° C. A lime sludge of 125 g $Ca(OH)_2$ and 125 g $H_2O$ (1:1) was added to the previously dried sinter coke and the coke was thoroughly mixed with the lime sludge. After that, it was dried again in a drying chamber.

EXAMPLE 2

1000 g sinter coke with a particle size of 1 to 3 mm were again dried at 105° C. in a drying chamber and a lime sludge consisting of 125 g $Ca(OH)_2$ and 250 g $H_2O$ (1:2) was added. The coke was thoroughly mixed with the lime sludge and stored in the drying chamber.

EXAMPLE 3

1000 g sinter coke with a particle size of to 3 mm were previously dried at 105° C. in a drying chamber and mixed with a lime sludge consisting of 125 g $Ca(OH)_2$ and 375 g $H_2O$ (1:3). The mixture was aged in the drying chamber.

EXAMPLE 4

1000 g previously dried sinter coke with a particle size of 1 to 3 mm were rolled with 125 g dried lime hydrate and the lime that did not adhere was removed by draining with a 0.5 mm sieve.

EXAMPLE 5

1000 g previously dried sinter coke with a particle size of 1 to 3 mm was rolled with 250 g dried lime hydrate and the lime that did not adhere was removed by draining with a sieve having a 0.5 mm mesh width.

EXECUTION OF TEST

Each of the mixtures produced in examples 1 to 5 of coke and lime sludge and/or coke and lime hydrate as well as a test sample consisting of 1000 g untreated coke were subjected to the following procedure.

A sample quantity of the coke mixed with lime sludge and/or lime hydrate was placed in a retort and heated in a rotary oven with forced air having a heating rate of approx. 5° C./min. During the heating phase, the waste gas composition was continuously measured. The ignition point of the sample mixtures were characterized by a significantly quicker increase in the sample temperature as well as the beginning $CO_2$ development. The ignition temperatures of the individual samples were, in Example 1 450° C., in Example 2 455° C. and in Example 3 450° C. The ignition temperature of the sample in Example 4 was not determined and that of Example 5 was 495° C. In comparison to this, the ignition temperature of the untreated coke with a particle size of 1 to 3 mm was 490° C.

In another test, the pretreated sinter coke samples according to Examples 1 to 5 were subjected to incineration. The incineration was hereby executed at three different temperatures, namely 900° C., 1000° C. and 1100° C. The sulfur binding in the ashes was hereby determined by the preparation of a sulfur analysis before and after the incineration. The results of the sulfur binding in the ashes are shown in FIG. 1, which represents a block diagram of the sulfur binding in the ashes. In FIG. 1, the percent of sulfur binding is represented on the ordinate and on the abscissa, arranged next to each other, the results of the three incineration tests executed with untreated coke and with the sinter coke fine treated with lime hydrate. The sulfur binding is represented with 1, which was achieved with an incineration temperature of 900° C., the sulfur binding which was achieved with incineration at 1000° C. with 2 and the sulfur binding which was achieved with an incineration at 1100° C. with 3. From FIG. 1, it can clearly be seen that the untreated coke resulted in the lowest sulfur binding in the ashes at all three incineration temperatures. The highest sulfur binding value, namely 20.7%, was hereby achieved with the lowest incineration temperature (900° C.).

Relatively compensated sulfur binding values with the three incineration temperatures could be achieved with the sinter coke pretreated according to Example 1. The same is true for the sinter coke treated according to Example 3, however seen in total, the percentage values of the sulfur binding lie somewhat lower than those for the sinter coke pretreated according to Example 1.

An especially high sulfur binding value in the ashes, namely 96.5%, was achieved by incineration at 900° C. of the sinter coke pretreated according to Example 2. The sulfur binding values at incineration temperatures 1000 and 1100° C. hereby lie in about the range that was obtained for the incineration of the mixtures according to Example 1 and Example 3.

During incineration of the pretreated sinter coke obtained according to Example 4, only an average sulfur binding value of 86.8% could be achieved at an incineration temperature of 900° C. During incinerations at higher temperatures, the sulfur binding value at about 64% laid clearly below those values which could otherwise have been achieved with sinter coke pretreated with lime hydrate.

Particularly high sulfur binding values in the ashes could be achieved during incineration of the mixture of coke fine and dry lime hydrate produced according to Example 5. During the incineration at 900° C., a sulfur binding of 97.1% was hereby achieved at 900° C. and with incineration at 1000° C., still a sulfur binding of 93.8%.

Seen as a whole, the result is that the greatest respective sulfur binding percentage can be achieved at the lowest incineration temperature and the relatively lowest sulfur binding percentage at the highest incineration temperature. In any case, however, the percentages of sulfur binding in the sinter coke pretreated according to the invention was four times as high as that which could be achieved during incineration of untreated coke.

The sulfur emission via sinter exhaust gases depends on the sulfur content of the sinter coke. This sulfur basically burns into $SO_2$. A decrease in $SO_2$ formation is theoretically possible by sulfidic binding in the sinter itself.

By impregnating the sinter coke with milk of lime and/or rolling same with lime hydrate, an optimum distribution of the sulfide-with the sulfur in the fuel. During incineration of the coke during the sintering process, not only is at that $SO_2$ develops, but also CaS, since in the coke particles, reducing conditions are also possible.

The partial binding of the coke sulfur in the sinter reduces the $SO_2$ emission via the sinter exhaust gas and helps to maintain the prescribed emission values and/or to drop below them.

We claim:

1. Process for reduction of pollutant emissions of $SO_2$ during sintering of a fuel-containing mixture comprised of coke with a grain range of 0.5–5 mm, comprising the steps of drying the coke of the mixture by heating the mixture to a temperature of essentially 105° C. and contacting the dried coke with $Ca(OH)_2$ by the step selected from the group consisting of rolling the dried coke in dry Ca(OH), and impregnating the dried coke with a sludge of Ca(OH).

2. Process according to claim 1, wherein the amount of dry $Ca(OH)_2$ in relation to the amount of coke is 5–30 weight %.

3. Process according to claim 1 or 2, comprises 1 to 3 weight parts water per weight part $Ca(OH)_2$.

4. Process according to claim 1 or 2, wherein the coke has a grain range of 2 to 3 mm.

5. Process according to any one of claims 1 or 2, wherein the amount of $Ca(OH)_2$ sludge in relation to the amount of coke is 20–50 weight %.

6. Process according to claim 3 wherein the coke has a grain range of 1 to 3 mm.

7. Process according to claim 2, wherein the amount of dry $Ca(OH)_2$ in relation to the amount of coke is 10–25 weight %.

8. Process according to claim 5, wherein the amount of $Ca(OH)_2$ sludge in relation to the amount of coke is 25–50 weight %.

* * * * *